US006715949B1

(12) United States Patent
Fisher et al.

(10) Patent No.: US 6,715,949 B1
(45) Date of Patent: Apr. 6, 2004

(54) MEDIUM-HANDLING IN PRINTER FOR DONOR AND RECEIVER MEDIUMS

(75) Inventors: Terrence L. Fisher, Rochester, NY (US); Douglas J. Pfaff, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 15 days.

(21) Appl. No.: 10/247,933

(22) Filed: Sep. 20, 2002

(51) Int. Cl.[7] ..... B41J 13/03; B41J 11/04

(52) U.S. Cl. ..... 400/637; 400/120.01; 400/649

(58) Field of Search ..... 400/636, 637, 400/648, 649, 653, 120.01; 347/220, 218

(56) References Cited

U.S. PATENT DOCUMENTS

| | | | | |
|---|---|---|---|---|
| 4,439,051 | A | 3/1984 | Lawter | 400/605 |
| 4,728,963 | A | 3/1988 | Rasmussen et al. | 346/25 |
| 4,780,007 | A | 10/1988 | Weeks et al. | 400/56 |
| 4,784,504 | A | 11/1988 | Hamano et al. | 400/605 |
| 5,198,836 | A | 3/1993 | Saito et al. | 400/88 |
| 5,262,937 | A | 11/1993 | Mackin et al. | 347/232 |
| 5,266,969 | A | 11/1993 | Mochizuki | 347/172 |
| 5,549,400 | A | 8/1996 | Tang et al. | 400/236 |
| 5,718,523 | A | 2/1998 | Shiina et al. | 400/120.04 |
| 6,196,740 | B1 * | 3/2001 | Yamaguchi et al. | 400/615.2 |
| 2002/0012039 | A1 * | 1/2002 | Kimura et al. | 347/218 |

FOREIGN PATENT DOCUMENTS

| | | | | |
|---|---|---|---|---|
| JP | 01310977 A | * 12/1989 | | B41J/11/20 |
| JP | 07009718 A | * 1/1995 | | B41J/13/00 |

* cited by examiner

*Primary Examiner*—Daniel J. Colilla
(74) *Attorney, Agent, or Firm*—Roger A. Fields

(57) ABSTRACT

A printer includes a print head for printing from a donor medium to a receiver medium, a platen member for holding the donor medium in a printing relation with the receiver medium at said print head, a pair of steering and drive rollers for feeding the receiver medium from between the steering and drive rollers, and a movable support for the platen member and the steering roller that moves the platen member towards the print head to hold the receiver medium in the printing relation with the donor medium and away from the print head to release the receiver medium from the printing relation with the donor medium and that moves the steering roller to vary a feeding angle at which the receiver medium is fed from between the steering and driver rollers. The support is movable to three positions, a print position in which the platen member is moved towards the print head to hold the receiver medium in the printing relation with the donor medium and the steering roller is moved to change the feeding angle to one for advancing the receiver medium, a feed-only position in which the platen member is moved away from the print head to release the receiver medium from the printing relation with the donor medium and the steering roller is moved to change the feeding angle to one for returning the receiver medium, and an exit position in which the platen member is moved away from the print head farther than in the feed-only position and the steering roller is moved to change the feeding angle to one for exiting the receiver medium.

5 Claims, 5 Drawing Sheets

MEDIUM-HANDLING IN PRINTER FOR DONOR AND RECEIVER MEDIUMS

FIELD OF THE INVENTION

The invention relates generally to printers for use with donor and receiver mediums such dye transfer printers, and in particular to a mode of medium-handling in the printer.

BACKGROUND OF THE INVENTION

A typical dye transfer or dye donor web that is used in a dye transfer printer such as a thermal printer includes a repeating series of three different primary color sections or patches such as a yellow color section, a magenta color section and a cyan color section.

To make a color image print, the respective color dyes (or inks) in a single series of yellow, magenta and cyan color sections on a donor web must be successively heat-transferred imagewise by a print head onto a dye receiver such as paper or transparency sheet or roll. This is generally done according to the following steps (when the dye receiver is a single sheet).

1. The dye donor web and the dye receiver are advanced forward in unison, with a yellow color section of the donor web moving in contact with the dye receiver longitudinally over a bead of selectively heated resistive elements on the print head in order to effect a line-by-line yellow dye transfer imagewise from the yellow color section to the dye receiver. A donor take-up spool draws the dye donor web forward over the print head, and a pair of pinch and drive rollers draw the dye receiver forward over the print head. A platen roller holds the dye receiver in a dye receiving relation with the dye donor web at the print head.
2. Once the yellow dye transfer is completed, the platen roller is retracted from adjacent the print head to allow the pair of pinch and drive rollers to return the dye receiver rearward in preparation for a second pass over the print head.
3. Then, the platen roller is returned to adjacent the print head, and the donor web and the dye receiver are advanced forward in unison, with a magenta color section of the donor web moving in contact with the dye receiver longitudinally over the print head in order to effect a line-by-line magenta dye transfer imagewise from the magenta color section to the dye receiver. The magenta dye transfer to the dye receiver is in exactly the same area on the dye receiver as was subjected to the yellow dye transfer.
4. Once the magenta dye transfer is completed, the platen roller is retracted from adjacent the print head to allow the pair of pinch and drive rollers to return the dye receiver rearward in preparation for a third pass over the print head.
5. Then, the platen roller is returned to adjacent the print head, and the donor web and the dye receiver are advanced forward in unison, with a cyan color section of the donor web moving in contact with the dye receiver longitudinally over the print head in order to effect a line-by-line cyan dye transfer imagewise from the magenta color section to the dye receiver. The cyan dye transfer to the dye receiver is in exactly the same area on the dye receiver as was subjected to the yellow and magenta dye transfers.
6. Once the cyan dye transfer is completed, the platen roller is retracted from adjacent the print head to allow the dye receiver to be returned rearward in preparation for exiting the printer.
7. Then, the pair of pinch and drive rollers advance the dye receiver forward to an exit tray.

Prior art U.S. Pat. No. 5,718,523 issued Feb. 17, 1998 discloses a dye transfer printer in which a platen roller, a pair of entrance pinch and drive rollers, and a pair of exit pinch and drive rollers are mounted on a pivotable support that pivots about an axis of the exit drive roller. When the support is pivoted in one direction, the platen roller is pivoted towards the print head to hold the dye receiver in the dye receiving relation with the donor web, and the entrance pitch and drive rollers and the exit pinch roller are pivoted to similarly change their identical feeding angle at which the dye receiver is successively fed from between the entrance and exit pinch and drive rollers. When the support is pivoted in a reverse direction, the platen roller is pivoted away from the print head to release the dye receiver from the dye receiving relation with the donor web and the entrance pitch and drive rollers and the exit pinch roller are pivoted to change their identical feeding angle back to the original one.

SUMMARY OF THE INVENTION

A printer comprising a print head for printing from a donor medium to a receiver medium, a platen member for holding the donor medium in a printing relation with the receiver medium at said print head, a pair of steering and drive rollers for feeding the receiver medium from between the steering and drive rollers, and a movable support for the platen member and the steering roller that moves the platen member towards the print head to hold the receiver medium in the printing relation with the donor medium and away from the print head to release the receiver medium from the printing relation with the donor medium and that moves the steering roller to vary a feeding angle at which the receiver medium is fed from between the steering and driver rollers, is characterized in that:

the support is movable to three positions, a print position in which the platen member is moved towards the print head to hold the receiver medium in the printing relation with the donor medium and the steering roller is moved to change the feeding angle to one for advancing the receiver medium, a feed-only position in which the platen member is moved away from the print head to release the receiver medium from the printing relation with the donor medium and the steering roller is moved to change the feeding angle to one for returning the receiver medium, and an exit position in which the platen member is moved away from the print head farther than in the feed-only position and the steering roller is moved to change the feeding angle to one for exiting the receiver medium.

DETAILED DESCRIPTION OF THE INVENTION

FIGS. 1–5 depict the successive steps in a dye transfer printer such as a thermal color-printer 10 to make a color image print.

Figure 1:
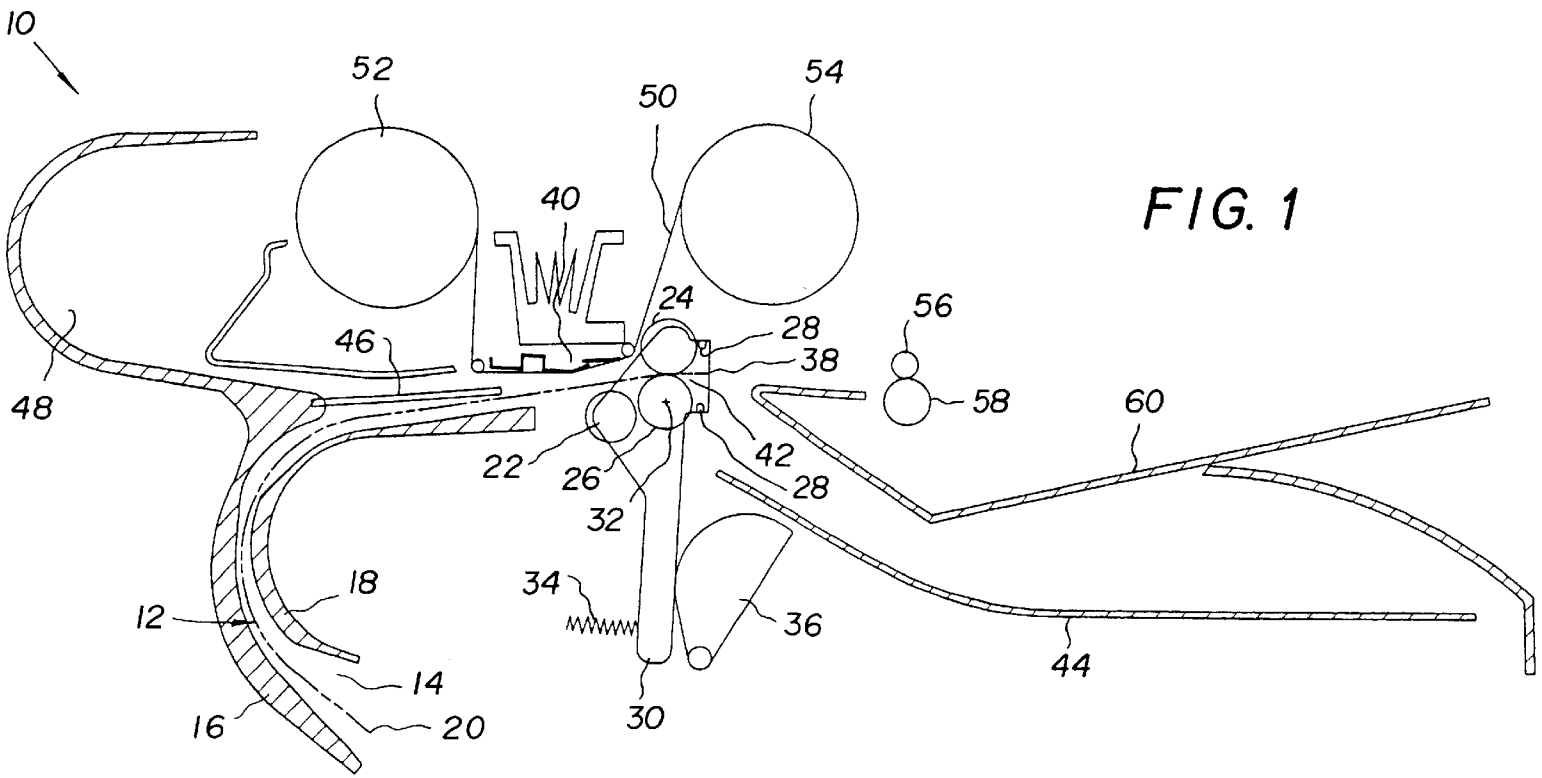
FIG. 1 is an elevation section view, partly in section, of a dye transfer printer, showing various components in a start position for a dye transfer image-printing operation, according to a preferred embodiment of the invention.

Beginning with FIG. 1, a dye receiver sheet 12, e.g. paper or transparency, is initially advanced forward via a kick or pick roller (not shown), off a floating platen (not shown) in a tray (not shown), and into a channel 14 defined by a pair of curved longitudinal guides 16 and 18. When a trailing (rear) edge sensor such as an emitter and a receiver (not shown) midway in the channel 14 senses a trailing or rear edge 20 of the dye receiver sheet 12, it activates a pair of contacting urge rollers (not shown) in the channel. The activated urge rollers advance or feed the dye receiver sheet 12 forward from between the rollers, past a platen (idler) roller 22 and to a pair of contacting steering or pinch (idler) and drive or capstan rollers 24 and 26, positioned beyond the channel 14. The pair of steering and drive rollers 24 and 26 are activated (when the urge rollers are activated) to advance or feed the dye receiver sheet 12 forward from between the rollers to a leading (front) edge sensor 28 such as an emitter and receiver. The platen roller 22, the steering roller 24, the drive roller 26, and the leading edge sensor 28 are mounted on a pivotable support 30 that is pivotable about an axis 32 of the drive roller and is urged by a compression spring 34 to pivot counter-clockwise in FIG. 1 continuously against a pivotable cam 36 in FIG. 1. The support 30 including the platen roller 22, the steering and drive rollers 24 and 26, and the leading edge sensor 28 are depicted in a start position for the dye receiver sheet 12 in FIG. 1.

Figure 2:
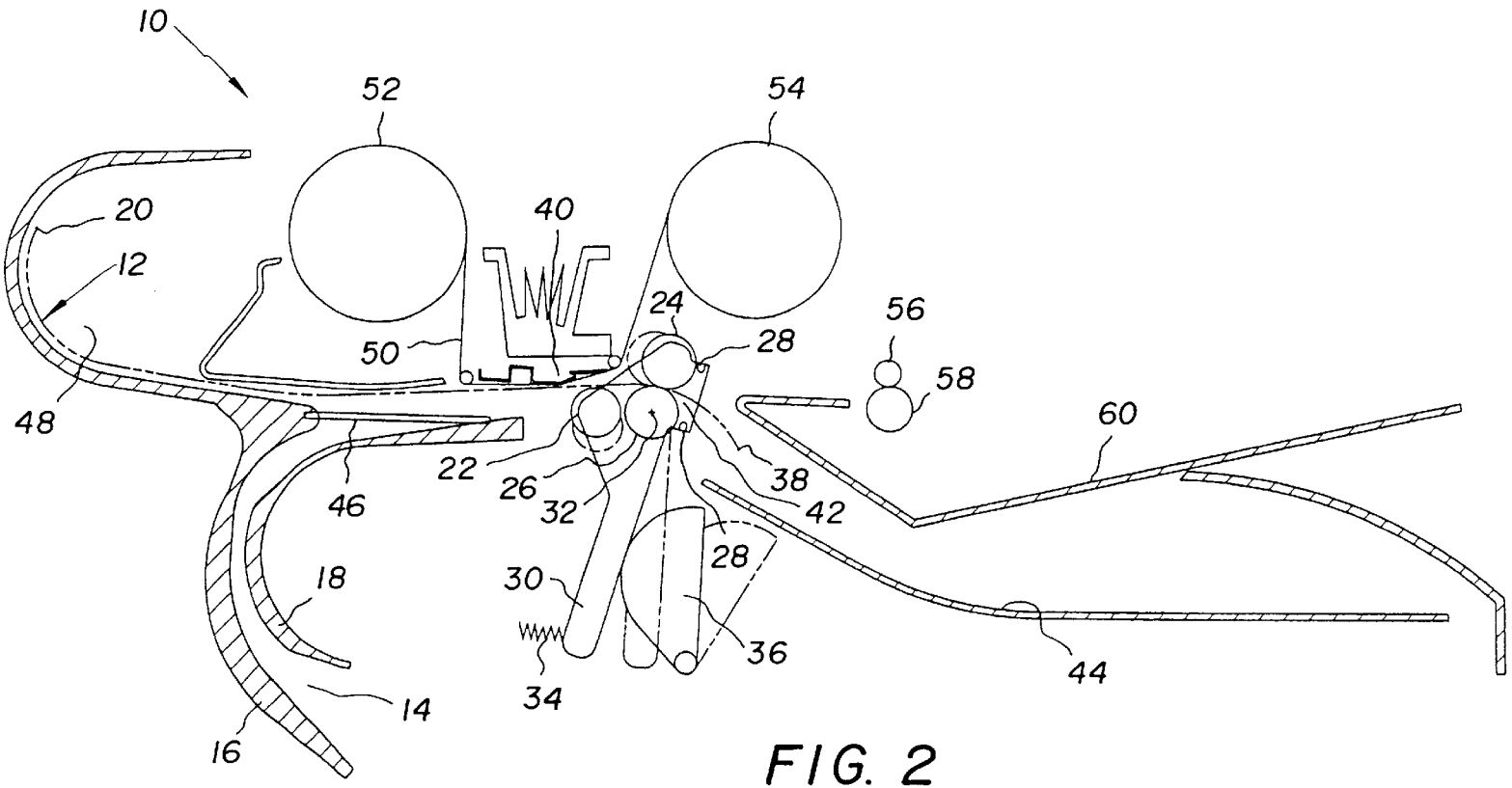
FIG. 2 is an elevation view, partly in section, of the dye transfer printer, showing the components in an initial advance and return position for a dye receiver sheet.

In FIG. 2, the leading edge sensor 28 has sensed a leading or front edge 38 of the dye receiver sheet 12. As a result, the cam 36 is pivoted counter-clockwise in FIG. 2 from the start position in FIG. 1 to pivot the support 30 clockwise +X° about the axis 32 of the drive roller 26 in order to pivot the platen roller 22 from the start position in FIG. 1, towards a print head 40, and to pivot the steering roller 24 from the start position in FIG. 1, to change a feeding angle 42 at which the dye receiver sheet 12 is fed from between the steering and drive rollers. The support 30 including the platen roller 22, and the steering and drive rollers 24 and 26 (and the leading edge sensor 28) are depicted in FIG. 2 in an initial advance and return position for the dye receiver sheet 12 as compared to the start position of these components in FIG. 1.

When the steering and drive rollers 24 and 26 are in the initial advance and return position for the dye receiver sheet 12 in FIG. 2, the steering and drive rollers 24 and 26 first advance the dye receiver sheet forward from between the rollers and partially onto an intermediate tray 44. The dye receiver sheet 12 is advanced forward onto the intermediate tray 44 so that the trailing or rear edge 20 of the dye receiver sheet can be moved beyond a hinged exit door 46 which is pivotally connected to the curved guide 16. Then, as illustrated, the hinged exit door 46 closes and the steering and drive rollers 24 and 26 are reversed to advance (return) the dye receiver sheet 12 rearward, i.e. rear edge 20 first, partially into a rewind chamber 48.

To make a color image print, respective color dyes (or inks) in a single series of yellow, magenta and cyan color sections (not shown) on a dye donor web 50 must be successively heat-transferred imagewise by the print head 40 onto the same area on the dye receiver sheet 12.

Figure 3:
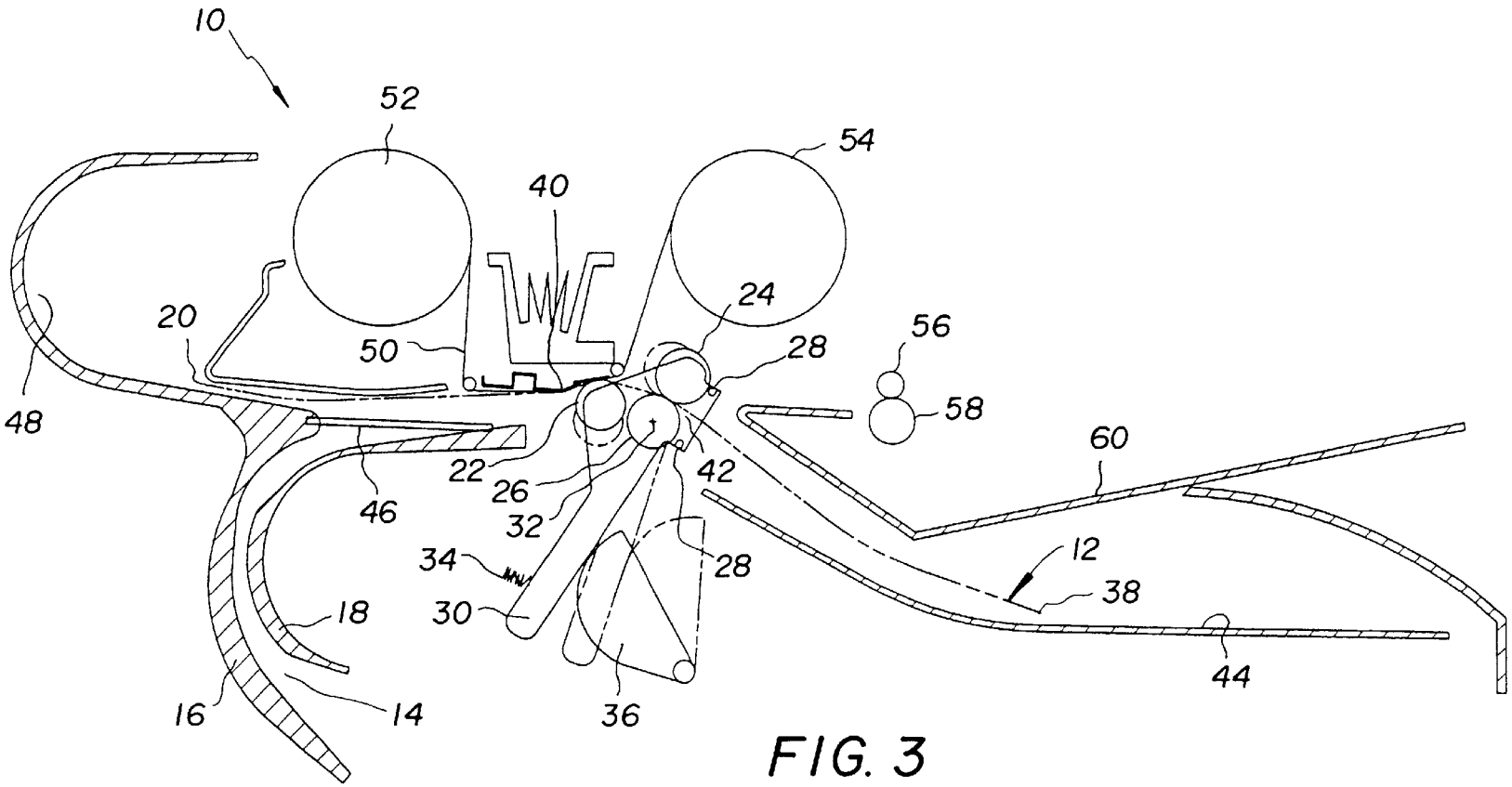
FIG. 3 is an elevation view, partly in section, of the dye transfer printer, showing the components in a print or dye transfer position for a dye donor web and the dye receiver sheet.

In FIG. 3, the cam 36 is pivoted counter-clockwise from the initial advance and return position in FIG. 2 to pivot the support 30 clockwise +Y° about the axis 32 of the drive roller 26 in order to pivot the platen roller 22 from the initial and return position in FIG. 2, to adjacent the print head 40, and to pivot the steering roller 24 from the initial and return position in FIG. 2, to change the feeding angle 42 at which the dye receiver sheet 12 is fed from between the steering and drive rollers. The support 30 including the platen roller 22, and the steering and drive rollers 24 and 26 (and the leading edge sensor 28) are depicted in FIG. 3 in a print or dye transfer position for the dye receiver sheet 12 and the dye donor web 50 as compared to the initial advance and return position of these components in FIG. 2.

Pivoting the platen roller 22 to adjacent the print head 40 causes the dye receiver sheet 12 and the yellow color section of the dye donor web 50 to be locally held together between the platen roller and the print head so that the dye receiver sheet is in a print or dye receiving relation with the dye donor web. The steering and drive rollers 24 and 26 are reversed to again advance the dye receiver sheet 12 forward to begin to return the dye receiver sheet to the intermediate tray 44. At the same time, the dye donor web 50 is advanced forward under a longitudinal tension, from a donor supply spool 52, over the print head 40, and onto a donor take-up spool 54. The donor supply and take-up spools 52 and 54 together with the dye donor web 50 can be provided in a replaceable cartridge (not shown) that is loaded into the printer 10.

The dye donor web 50 and the dye receiver sheet 12 are advanced forward in unison, with the yellow color section of the dye donor-web moving in contact with the dye receiver sheet longitudinally over a bead of selectively heated resistive elements (not shown) on the print head 40 in order to effect a line-by-line yellow dye transfer imagewise from the yellow color section to the dye receiver sheet in FIG. 3. The donor take-up spool 54 draws the dye donor web 50 forward over the print head 40, and the pinch and drive rollers 24 and 26 draw the dye receiver 12 forward over the print head. At the same time, the platen roller 22 holds the dye receiver sheet 12 in the print or dye receiving relation with the dye donor web 50.

Once the yellow dye transfer is completed, the cam 36 is pivoted clockwise from the print or dye transfer position in FIG. 3 to allow the spring 34 to pivot the support 30 clockwise –(minus) Y° about the axis 32 of the drive roller 26 in order to pivot the platen roller 22 from the print or dye transfer position adjacent the print head 40 in FIG. 3 to away from the print head, and to pivot the steering roller 24 from the print or dye transfer position in FIG. 3, to change the feeding angle 42 at which the dye receiver sheet 12 is fed from between the steering and drive rollers to the same angle as in FIG. 2. The support 30 including the platen roller 22, and the steering and drive rollers 24 and 26 (and the leading edge sensor 28) are depicted in FIG. 4 in a normal return position for the dye receiver sheet 12 as compared to the print or dye transfer position of these components in FIG. 3.

Figure 4:
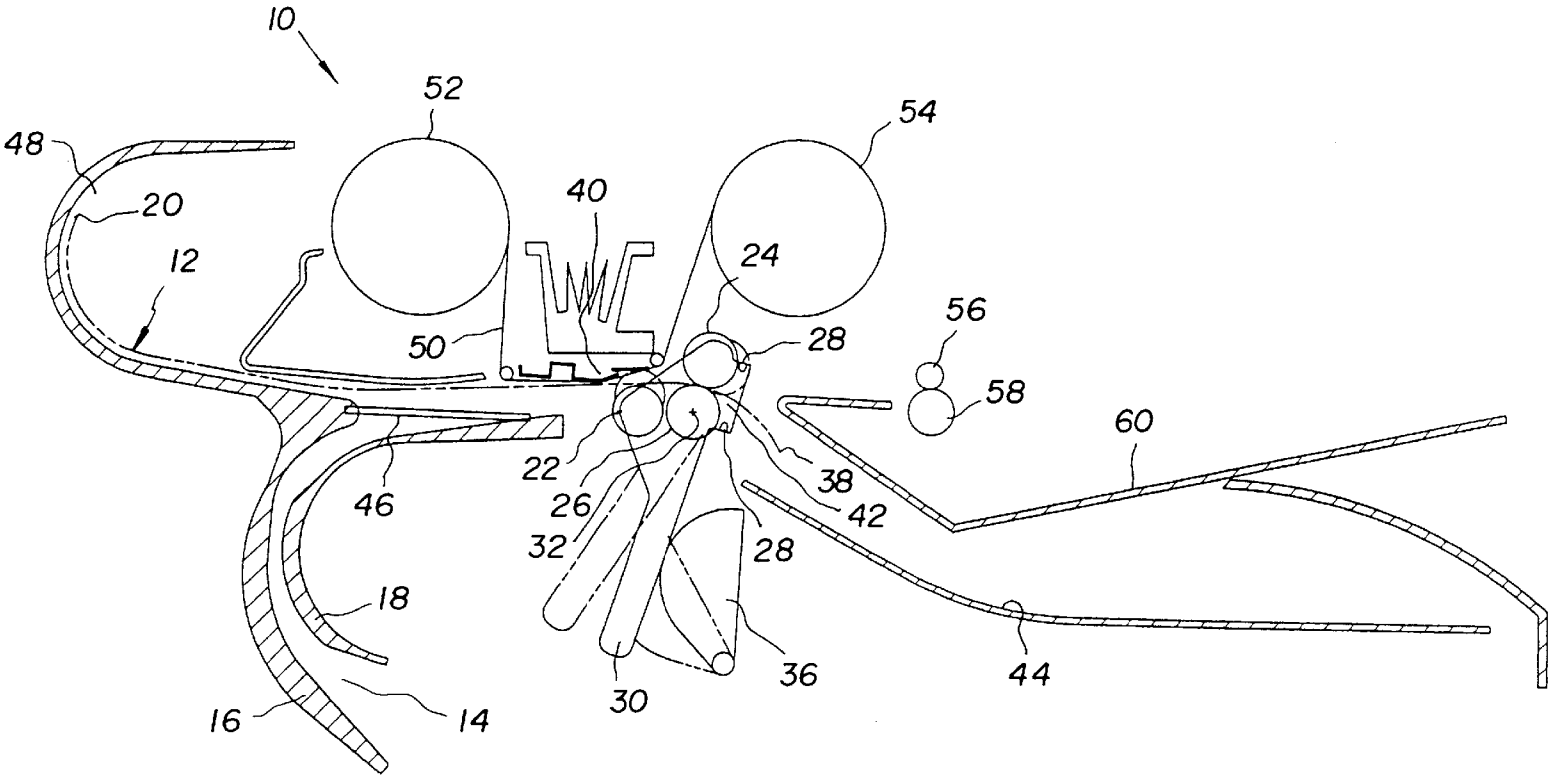
FIG. 4 is an elevation view, partly in section, of the dye transfer printer, showing the components in an normal return or feed-only position for the dye receiver sheet.

The steering and drive rollers 24 and 26 are reversed in FIG. 4 to advance (return) the dye receiver sheet 12 rearward, i.e. rear edge 20 first, partially into the rewind chamber 48. This is done in preparation for a second pass of the dye receiver sheet 12 over the print head 40.

Next, the steps are repeated first in FIG. 3 and then in FIG. 4. This time in FIG. 3 the dye donor web 50 and the dye receiver sheet 12 are advanced forward in unison, with the magenta color section of the dye donor web moving in contact with the dye receiver sheet longitudinally over the print head 40 in order to effect a line-by-line magenta dye transfer imagewise from the magenta color section to the dye receiver sheet. The magenta dye transfer to the dye receiver sheet 12 is in exactly the same area on the dye receiver sheet as was subjected to the yellow dye transfer. When the magenta dye transfer is completed, the steering and drive rollers 24 and 26 are reversed in FIG. 4 to advance (return) the dye receiver sheet 12 rearward, i.e. rear edge 20 first, partially into the rewind chamber 48. This is done in preparation for a third pass of the dye receiver sheet 12 over the print head 40.

Next, the steps are repeated first in FIG. 3 and then in FIG. 4. This time in FIG. 3 the dye donor web 50 and the dye receiver sheet 12 are advanced forward in unison, with the cyan color section of the dye donor web moving in contact with the dye receiver sheet longitudinally over the print head 40 in order to effect a line-by-line cyan dye transfer imagewise from the cyan color section to the dye receiver sheet. The cyan dye transfer to the dye receiver sheet 12 is in exactly the same area on the dye receiver sheet as was subjected to the yellow and magenta dye transfers. When the cyan dye transfer is completed, the steering and drive rollers 24 and 26 are reversed in FIG. 4 to advance (return) the dye receiver sheet 12 rearward, i.e. rear edge 20 first, partially into the rewind chamber 48. This is done in preparation for the dye receiver sheet 12 exiting the printer 10.

Finally, the can 36 is pivoted clockwise from the normal return or feed-only position in FIG. 4 to allow the spring 34 to pivot the support 30 counter-clockwise –(minus) X° about the axis 32 of the drive roller 26 in order to pivot the platen roller 22 from the normal return or feed-only position away from the print head 40 in FIG. 4 to farther away from the print head, and to pivot the steering roller 24 from the normal return or feed-only position in FIG. 4, to change the feeding angle 42 at which the dye receiver sheet 12 is fed from between the steering and drive rollers to the same angle as in FIG. 1. The support 30 including the platen roller 22, and the steering and drive rollers 24 and 26 (and the leading edge sensor 28) are depicted in FIG. 5 in an exit position for the dye receiver sheet 12 as compared to the normal return or feed-only position of these components in FIG. 4.

Figure 5:
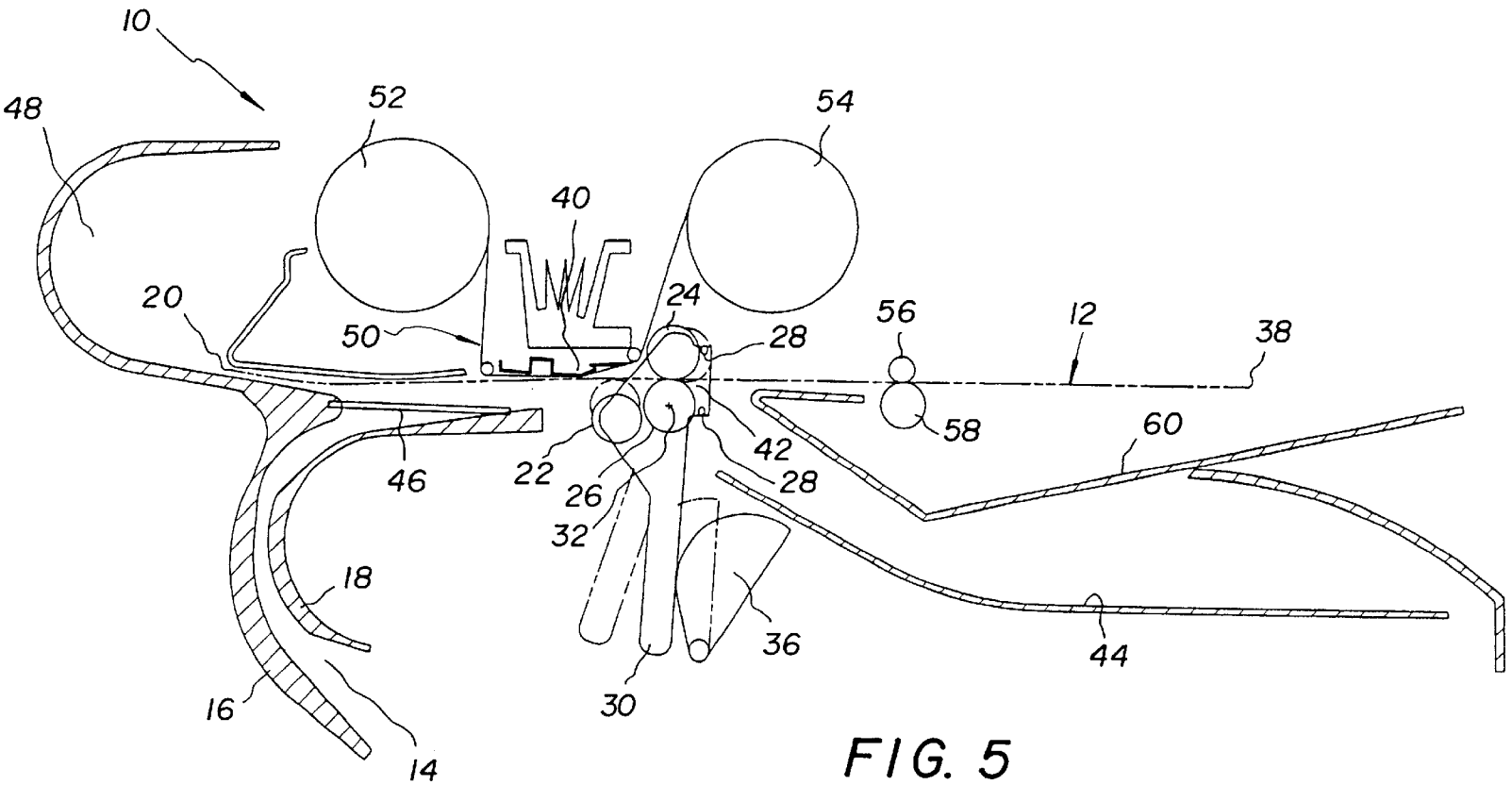
FIG. 5 is an elevation view, partly in section, of the dye transfer printer, showing the components in an exit position for the dye receiver sheet.

The steering and drive rollers 24 and 26 are reversed in FIG. 5 to advance the dye receiver sheet 12 forward to a pair of contacting pinch and drive rollers 56 and 58 which are activated to advance or feed the dye receiver sheet 12 completely into an exit tray 60.

The invention has been described in detail with particular reference to certain preferred embodiments thereof, but it will be understood that variations and modifications can be effected within the spirit and scope of the invention.

PARTS LIST

10. thermal printer
12. dye receiver sheet
14. channel
16. longitudinal guide
18. longitudinal guide
20. trailing or rear edge
22. platen roller
24. steering or pinch roller
26. drive or capstan roller
28. leading edge sensor
30. support
32. axis
34. compression spring
36. cam
38. leading or front edge
40. print head
42. feeding angle
44. intermediate tray
46. exit door
48. rewind chamber
50. dye donor web
52. donor supply spool
54. donor take-up spool
56. pinch roller
58. drive roller
60. exit tray

What is claimed is:

1. A printer comprising a print head for printing from a donor medium to a receiver medium, a platen member for holding the donor medium in a printing relation with the receiver medium at said print head, a pair of steering and drive rollers for feeding the receiver medium from between said steering and drive rollers, and a movable support for said platen member and said steering roller that moves said platen member towards said print head to hold the receiver medium in said printing relation with the donor medium and away from said print head to release the receiver medium from said printing relation with the donor medium and that moves said steering roller to vary a feeding angle at which the receiver medium is fed from between said steering and driver rollers, is characterized in that:

said support is movable to three positions, a print position in which said platen member is moved towards said print head to hold the receiver medium in said printing relation with the donor medium and said steering roller is moved to change said feeding angle to one for advancing the receiver medium, a feed-only position in which said platen member is moved away from said print head to release the receiver medium from said printing relation with the donor medium and said steering roller is moved to change said feeding angle to one for returning the receiver medium, and an exit position in which said platen member is moved away from said print head farther than in said feed-only position and said steering roller is moved to change said feeding angle to one for exiting the receiver medium.

2. A printer as recited in claim 1, wherein said support is pivotable about an axis of said drive roller to pivot said platen about said axis to move said platen member towards and away from said print head and to pivot said steering roller about said axis to move said steering roller to vary said feeding angle.

3. A dye transfer printer comprising a print head for thermal dye transfer from a dye donor to successive dye receivers, a platen roller for holding a dye receiver in a dye receiving relation with the dye donor at said print head, a pair of steering and drive rollers for feeding the dye receiver from between said steering and drive rollers, and a pivotable support for said platen roller and said steering roller that pivots about an axis of said drive roller to pivot said platen roller about said axis and towards said print head to hold the dye receiver in said dye receiving relation with the dye donor and away from said print head to release the dye receiver from said dye receiving relation with the dye donor and to pivot said steering roller about said axis to vary a feeding angle at which the dye receiver is fed from between said steering and driver rollers, is characterized in that:

said support is pivotable to various positions including a print position in which said platen roller is pivoted towards said print head to hold the dye receiver in said dye receiving relation with the dye donor and said steering roller is pivoted to change said feeding angle to one for advancing the dye receiver, a feed-only position in which said platen roller is pivoted away from said print head to release the dye receiver from said dye receiving relation with the dye donor and said steering roller is pivoted to change said feeding angle to one for returning the dye receiver, and an exit position in which said platen roller is pivoted away from said print head farther than in said feed-only position and said steering roller is pivoted to change said feeding angle to one for exiting the dye receiver.

4. A dye transfer printer as recited in claim 3, wherein said support has a start position for advancing a dye receiver to between said steering and drive rollers from a supply source and that is the same as said exit position in order that said platen roller is pivoted away from said print head farther than in said feed-only position.

5. A medium-handling method in a printer that includes a print head for printing from a donor medium to a receiver medium, a platen member for holding the donor medium in a printing relation with the receiver medium at said print head, a pair of steering and drive rollers for feeding the receiver medium from between the steering and drive rollers, and a movable support for the platen member and the steering roller that moves the platen member towards the print head to hold the receiver medium in the printing relation with the donor medium and away from the print head to release the receiver medium from the printing relation with the donor medium and that moves the steering roller to vary a feeding angle at which the receiver medium is fed from between the steering and driver rollers, said method comprising:

moving the support to three positions, a print position in which the platen member is moved towards the print head to hold the receiver medium in the printing relation with the donor medium and the steering roller is moved to change the feeding angle to one for advancing the receiver medium, a feed-only position in which the platen member is moved away from the print head to release the receiver medium from the printing relation with the donor medium and the steering roller is moved to change the feeding angle to one for returning the receiver medium, and an exit position in which the platen member is moved away from the print head farther than in the feed-only position and the steering roller is moved to change the feeding angle to one for exiting the receiver medium.

* * * * *